US005096072A

United States Patent [19]

Link

[11] Patent Number: 5,096,072

[45] Date of Patent: Mar. 17, 1992

[54] FOLD OUT CARRYING DEVICE

[76] Inventor: Drew R. Link, 120 Beaver Run Rd., Covington, Ga. 30209

[21] Appl. No.: 649,962

[22] Filed: Feb. 4, 1991

[51] Int. Cl.[5] ..... A47F 5/00

[52] U.S. Cl. ..... 211/132; 211/130; 211/195; 248/166

[58] Field of Search ..... 211/85, 130, 132, 195, 211/149; 108/99; 182/165; 248/166, 439

[56] References Cited

U.S. PATENT DOCUMENTS

| | | | |
|---|---|---|---|
| 226,935 | 4/1880 | Smart | 182/165 |
| 351,990 | 11/1886 | Mansure . | |
| 600,100 | 3/1898 | Tong . | |
| 701,532 | 6/1902 | Bardin | 182/165 X |
| 914,606 | 3/1909 | Sabo . | |
| 949,242 | 2/1910 | Milholland . | |
| 1,777,863 | 10/1928 | Seltzer . | |
| 2,129,401 | 9/1938 | Botinger et al. | 182/165 |
| 2,240,960 | 3/1938 | Sherwood . | |
| 2,390,640 | 8/1942 | Carlson . | |
| 2,454,575 | 11/1948 | Silene . | |
| 2,599,380 | 6/1952 | Galvin . | |
| 2,633,249 | 3/1953 | Reed | 211/130 |
| 3,527,360 | 9/1970 | Thielking . | |
| 3,893,648 | 7/1975 | Gilbert . | |

FOREIGN PATENT DOCUMENTS 3639698 1/1988 Fed. Rep. of Germany ..... 182/165

OTHER PUBLICATIONS

Hammacher Schlemmer brochure, p. 53.

*Primary Examiner*—Robert W. Gibson, Jr.
*Attorney, Agent, or Firm*—Cushman, Darby & Cushman

[57] ABSTRACT

A fold out carrying device or a "caddy." A frame with two front legs is pivotally supported by two longer rear legs. The front end of each of provided locks is rotatably attached to the frame and the rear hooked end slidably circumscribes one of the rear legs. To fold the caddie, the entire device is lifted. Consequently, front legs pivot rearwardly and the rear ends of the locks simply slide down the rear legs without manual aid or operation. Conversely, to open the caddie, the two rear legs are placed on the ground and the caddie is tilted forward such that its front legs tend gravitate away from the rear legs. During opening of the caddie, each of locks slides up along one of the rear legs. Locks are prevented from moving upwards beyond a certain point by stops attached to the rear legs. A number of containers are pivotally supported by the frame. These containers remain substantially vertically oriented whether the device is open or collapsed.

31 Claims, 5 Drawing Sheets

FOLD OUT CARRYING DEVICE

BACKGROUND OF THE INVENTION

1. Field of the Invention

The present invention relates to a fold out carrying device or "caddie." The caddie is designed for multiple purposes, such as displaying articles, storing and/or carrying auto-care equipments, items for household cleaning, pool and spa-care equipment, gardening equipment, barbecue supplies and other sorts of equipment or tools that may need to be carried from place to place.

2. Description of Related Art

U.S. Patents that disclose foldable devices and use of wire baskets include Gilbert U.S. Pat. No. 3,893,648, Mansure U.S. Pat. No. 351,990, Milholland U.S. Pat. No. 949,242, and Carlson U.S. Pat. No. 2,390,640.

Both Gilbert and Mansure disclose a concept of a manually openable, folding frame held in an open position by locking arms. In Gilbert, a spring attached to the locking arm pulls the locking arm upwardly, allowing the frame to close. Mansure also uses a spring to aid in closing the opened device.

Milholland illustrates foldable trestle table support legs. Each leg unit is comprised of two members pivotally connected together. One leg includes a longitudinally extending slot in which a bar is pivotally mounted. A closed U-shaped strap is mounted to the inside of the opposite leg and the other end of the bar has a closed loop that is fitted about the strap. As the legs are opened, the closed loop slides along the strap and prevents the legs from spreading apart farther than desired or from completely collapsing.

Carlson discloses a support stand comprised of a U-shaped front frame and a pair of parallel rear legs pivotally connected to the front frame. The device is held open by a connecting rod fixed to the front frame and slidable relative to a cross brace connected between the rear legs. The rod's position in the cross brace is controlled by a thumb screw. When the device needs to be folded or opened, the thumb screw must be manually loosened, the device can then be repositioned after which the thumb is retightened to lock the rod in its desired new position.

A folding step ladder is shown on page 53 of the Hammacher Schlemmer catalog for fall of 1990. This step ladder comprises a U-shaped front frame to which treads are mounted. The U-shaped structure is supported by two separate legs pivotally attached to the U-shaped frame. A cross brace is included between those two legs for support purposes. A manually operated, folding locking arm is pivotally connected between each leg and the U-shaped frame to hold each leg in its open position. This arm locks in a horizontal position and requires manual effort to both lock and unlock the arm and to open and close the support legs relative to the front U-shaped frame.

Each of the above devices is a type of display stand or rack, and includes a plurality of shelves that are supported between two members. Most can be somehow collapsed or folded together. However, none of the prior devices disclose a simple way of opening and automatically collapsing the support legs simply into a folded storage position while providing a positive lock in the open position.

SUMMARY OF THE INVENTION

It is an object of the present invention to provide an easily openable and closable stand for displaying, carrying, and storing various items.

The present invention comprises a U-shaped main frame and two rear legs pivotally secured to the main frame. A lock device is provided to hold the rear legs in their predetermined open position yet it allows easy folding of the legs in their closed position without requiring any manual unlocking or releasing operation. When the main frame is open, simply lifting the unit will automatically close the rear legs. The lock device simply slides down the rear leg or legs, depending whether one or two locking devices are used. The lock device pivots relative to the main frame and includes a portion extending around the rear leg with which it operates so that it remains engaged with the rear leg regardless of whether the leg is in its opened or closed condition.

Several containers are pivotally connected between the front legs. The pivotal connection has been designed to positively control the position of the containers thereby assuring that they will remain substantially vertically oriented whether the device is opened or closed.

Other objects, features and characteristics of the present invention, as well as the methods and operation and functions of the related elements of the structure and to the combination of parts and economies of manufacture, will become apparent upon consideration of the following description and the appended claims with references to the accompanying drawings, all of which form a part of this specification, wherein like reference numerals designate corresponding parts in the various figures.

DETAILED DESCRIPTION OF THE EXEMPLARY PREFERRED EMBODIMENT OF THE PRESENT INVENTION

Figure 1:
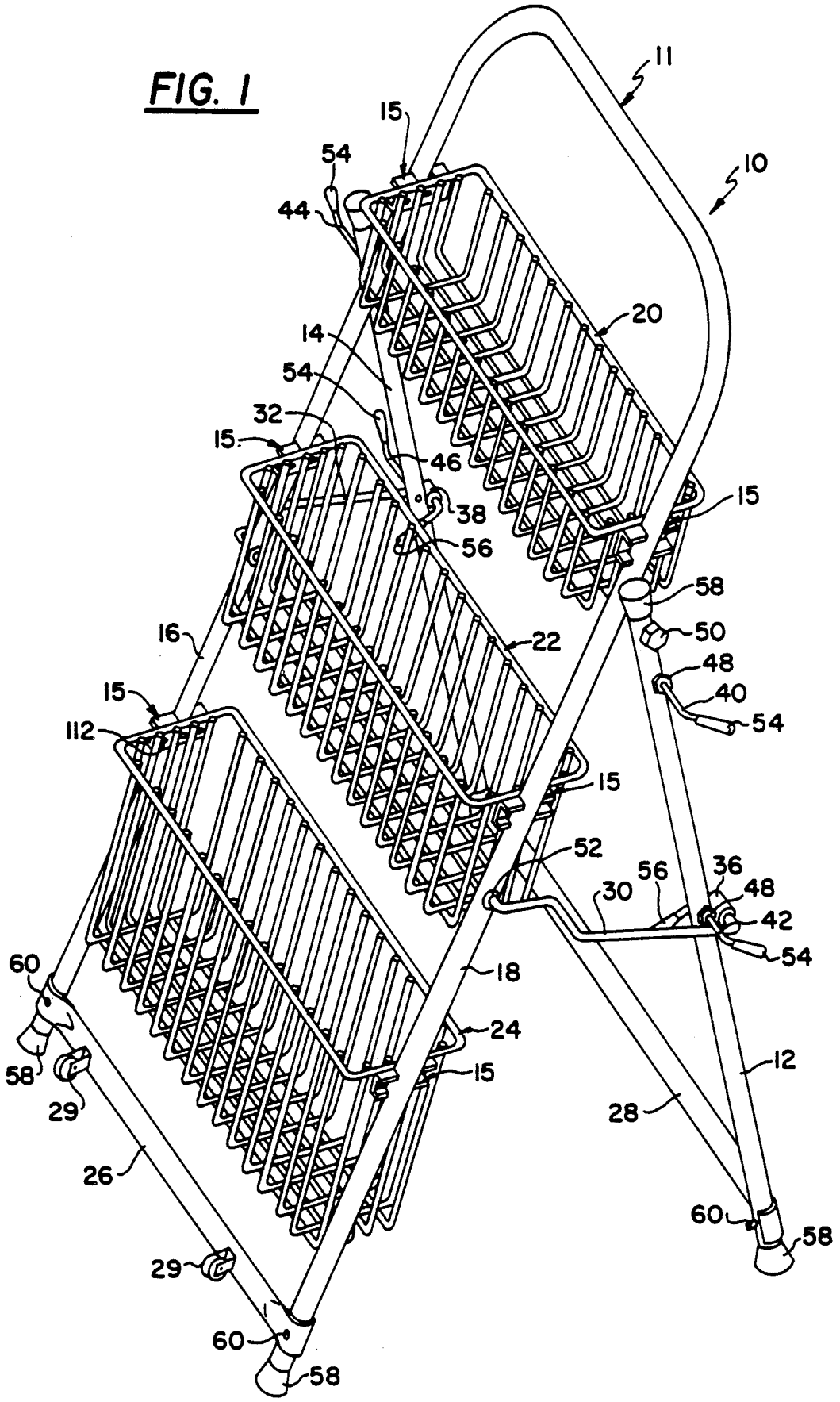
FIG. 1 is a top perspective view of the preferred exemplary embodiment of the present invention.
Figure 2:
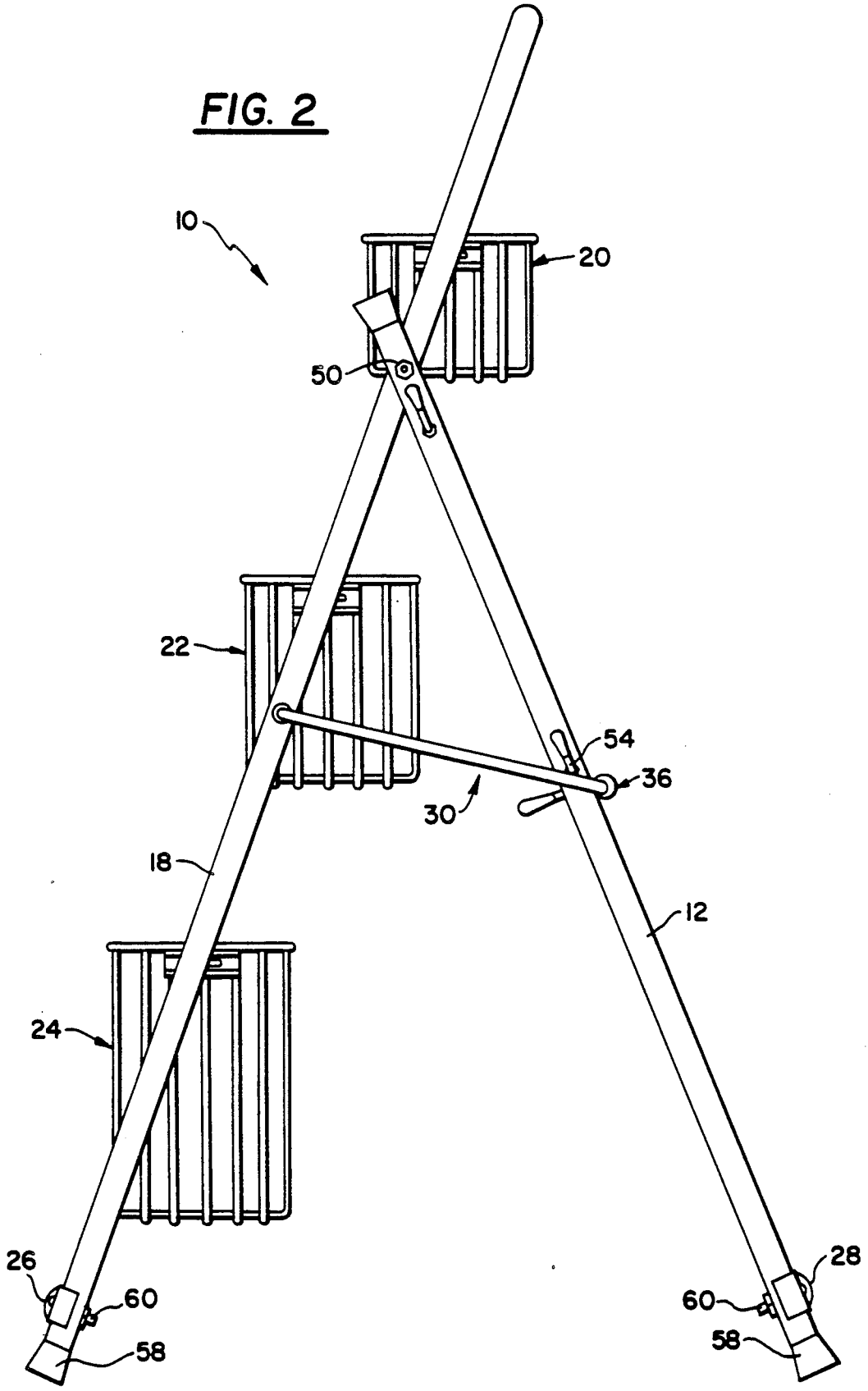
FIG. 2 is a side view thereof.
Figure 3:
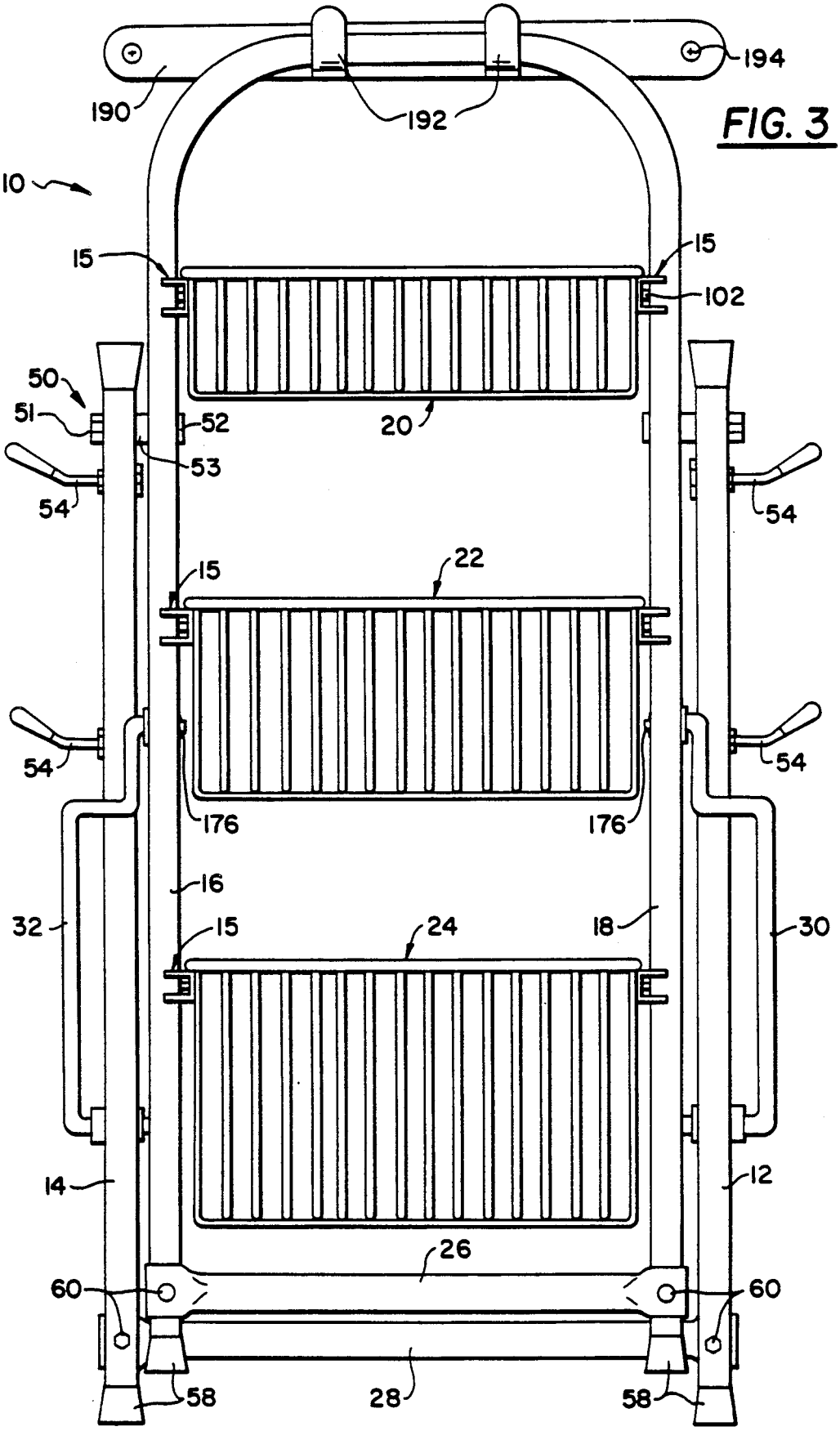
FIG. 3 is a front elevational view of the present invention in collapsed condition as hung on a wall.

FIG. 1 shows the folding device generally indicated at 10. The device is comprised of a front, substantially U-shaped frame 11, having a top, horizontal handle portion 13 from which two front legs 16 and 18 depend. A pair of rear support legs 12 and 14 are pivotally mounted in the upper portion of frame 11 by a bolt or rivet assembly 50. As shown in FIG. 3, the bolt assembly 50 is comprised of a nut 51, a screw 52 and a plastic spacing ring 53 between the leg of the U-shaped frame and the rear support leg. Containers 20, 22, 24 are each separately pivotally mounted between legs 16 and 18 by a pivotal member generally shown at 15. Each basket is rotatable but only within prescribed limits.

U-shaped frame can, for example, be formed from metal tubing and be approximately 15 inches wide and 39 inches in height. The metal tubing could have about a ¾ inch diameter, although larger or smaller diameters could be used. The rear support legs 12 and 14 can be similarly formed. It should be understood, however, that the invention can be made in other sizes and from other materials. For example, the main frame could be molded in one piece of plastic, thermosetting resins or other thermoplastic or man made material. Alternatively, the members could be formed separately and joined together. Also, the various members making up the mainframe or legs could be formed from hollow or solid pieces.

Rear support legs 12 and 14 could be about 30 inches in height, and be attached to frame 11 at a point about 10 inches below handle 13. When rear legs 12 and 14 are attached it is desirable that they extend downwards beyond the bottom end of front legs 16 and 18. As a consequence, only the rear legs will contact the ground or floor when the device is in its closed condition. With rear legs 12 and 14 on the floor, handle 13 can be easily rotated, thereby allowing easy rotation of the whole of frame 11 relative to the rear legs. As the frame 11 rotates away from the rear legs, the whole device can be rocked forward on the rear legs until the front legs touch the floor and the locking mechanism becomes fully engaged. This comprises the opening procedure for the device.

As noted above, baskets 20, 22, and 24 extend between front legs 16 and 18. Basket 20 may be placed about 7 inches from the top of U-shaped frame 11; basket 22 may be placed about 18 inches from the top of U-shaped frame 11; and basket 24 may be placed about 29 inches from the top of U-shaped frame 11. Approximate dimensions of the baskets 20, 22 and 24 are 13×5×3, 14×5×5.5, and 14×5×5.5 inches, respectively. Each basket 20, 22, or 24 is preferably made of wires that are welded together at their cross points. The baskets are generally in rectangular shape, with an opening at their top.

Even though wire baskets 20, 22, and 24 are used in the present embodiment, containers of different shape, type, or dimensions may also be used instead of baskets 20, 22, or 24. For example, sheet metal containers, each shaped as an elliptical paraboloid, may replace wire baskets 20, 22, or 24. The containers may have openings on their top or on their side. In addition, the containers may be smaller or larger than baskets 20, 22, or 24, provided that their shape and size allow them to swivel so that they may stay substantially vertically oriented as the caddie is opened or closed. The caddie may be designed so that it includes more or fewer than three containers.

Figure 4:
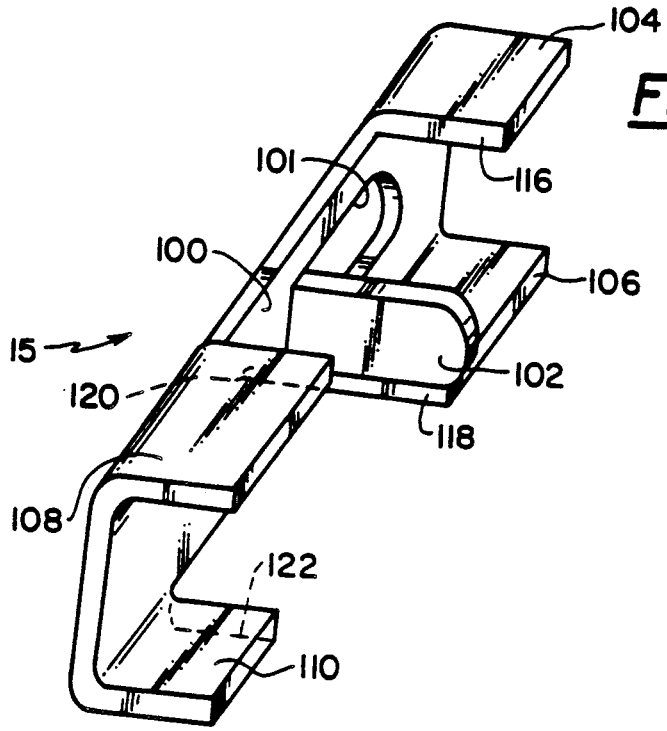
FIG. 4 is a perspective view of a first embodiment of a pivot member.

FIG. 4 illustrates one embodiment of pivot member 15. As shown, pivot member 15 includes a planar wall portion 100 from which a pivot finger 102 has been punched, leaving an opening 101. As shown, pivot finger 102 is positioned to be substantially normal to wall 100. Alternatively, pivot finger could be separately formed and fixed in a similar fashion to wall 100.

Pivot member 15 also includes four tabs, with tabs 104 and 106 being one pair on one end of wall 100 while tabs 108 and 110 being another pair positioned at the opposite end of wall 100.

Preferably the pivot member 15 is made of metal and is welded to the upper side wall of each container, as indicated at 112 for the lower basket in FIG. 1.

The connection between pivot member 15 and legs 16 and 18 is quite different. Pivot finger 102 is designed and dimensioned to extend into an opening formed on the inside surface of legs 16 and 18 as shown in the upper right portion in FIG. 3. With pivot finger 102 in hole 114, the remaining portion of the leg will be positioned between the interior edge 116, 118, 120 and 122 of tabs 104–110. Consequently, these edges of the pivot members will engage the outer surface of the leg to which each is associated to prevent rotation of the container beyond that permitted by the spacing between those edges and the outer surface of the leg.

It should also be understood that for each container only one pivot member, like that shown in 15, would be required to provide pivot control. One pivot member 15 would be positioned at one end and the other end would simply have the pivot finger. Of course, a pivot member 15 could be used at each end as shown in FIG. 1. All tabs can have an identical width of about ⅝ inch with lengths ranging between about ⅜ and about ⅝ inch. The dimension of planar wall portion 100, to which all tabs are attached, could be about ¾×2 inches. Pivot finger 102 can have vertical dimension of about 5/16 inch. When properly attached to a container, wall 100 of pivot member faces the container.

Figure 5:
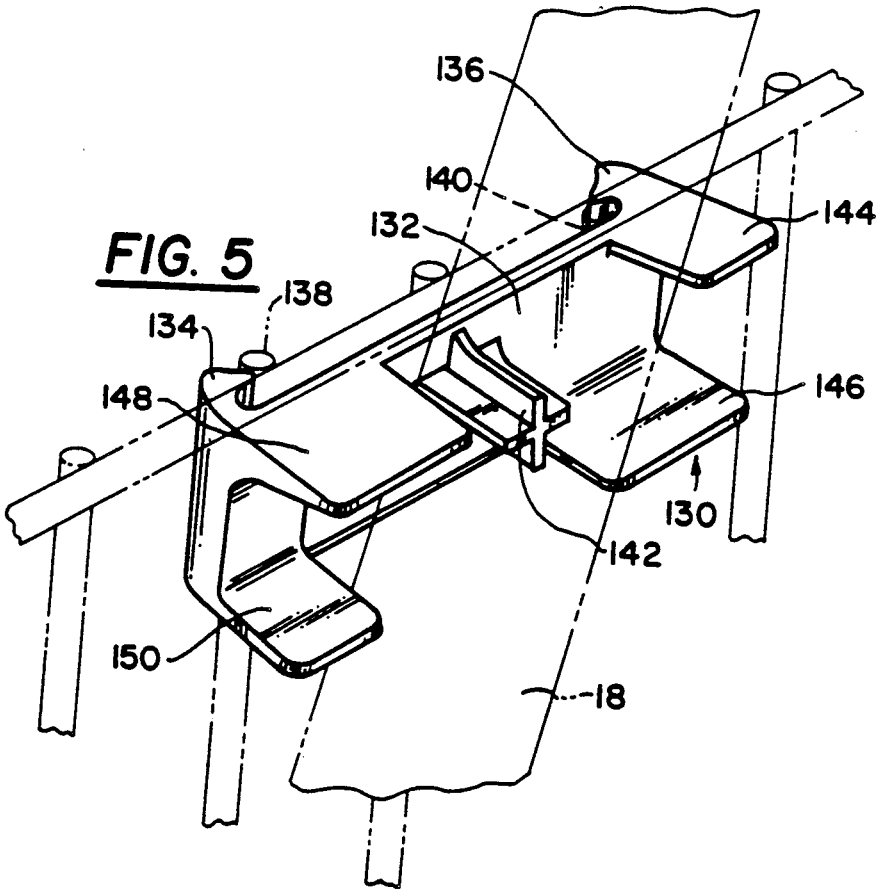
FIG. 5 is a perspective view of a second embodiment of a pivot member.

FIG. 5 shows another embodiment for the pivot member. The modified pivot member, generally indicated at 130, is preferably a one-piece molded member. Pivot member 130 includes a central wall 132 and the side facing the containers has vertically extending ribs 134 and 136 positioned adjacent and extending along each side. As shown in FIG. 5, ribs 134 and 136 are spaced apart a distance sufficient to allow those ribs to snap-fit over two vertically extending wires 138 and 140 provided in the end wall of the container.

Extending outwardly from the opposite side of wall 132 is a centrally positioned pivot finger 142 and four tabs 144, 146, 148 and 150. These tabs can be uniformly sized or, as shown in FIG. 5, tabs 146 and 148 can be longer while tabs 144 and 150 could be shorter in their horizontal dimension to cooperate with the desired angled position of the front legs, relative to the container when the device is open.

As noted above, member 130 is preferably molded as a one-piece member from a plastic, thermoplastic, thermosetting resin or other moldable material that would produce a strong enough finger and tab arrangement to adequately support the container and its expected contents. When the container is formed from sheeting or other material producing a solid end wall, the pivot member could be molded integrally with the end wall or, in view of ribs 134 and 136, that side of the pivot member could be comprised of a flat surface and be secured to the end wall by a suitable adhesive.

For stability front frame and rear legs are provided with cross-braces 26 and 28, respectively. Cross-braces 26 and 28 are affixed to the lower part of legs 16 and 18 of frame 11 by screws 60. Each cross-brace 26 and 28 is made preferably of ¾ inch tubing, with ends having been flattened and curved to fit the curvature of the legs. Cross-brace 28 is about 16.5 inches long, while brace 26 is about 15 inches long, so that when closed, as in FIG. 3, the front legs fit within the interior dimension of the rear legs. For convenience, or should the load contained in the containers be heavy, wheels, such as those shown in FIG. 1 at 29, could be attached either to the front cross brake 76 or alternatively to the legs.

Figure 6:
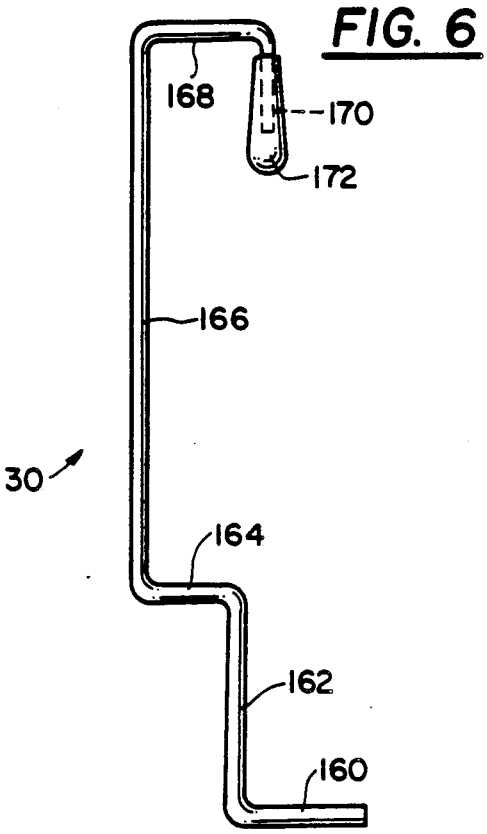
FIG. 6 shows a plan view of the lock mechanism.
Figure 7:
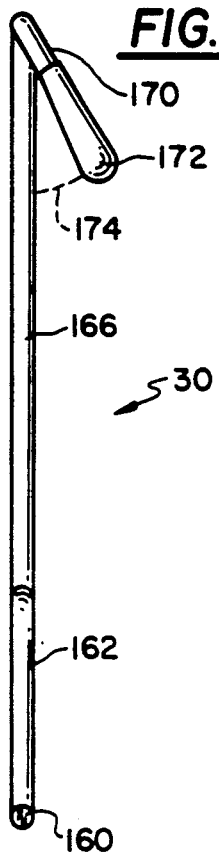
FIG. 7 shows a side elevational view of the lock mechanism.

Lock members 30 and 32 are attached to legs 18 and 16. Each lock 30 and 32 is preferably constructed from a bent rod or wire. However, the lock could also be molded. Each lock member has various segments indicated at 160–170. Reference can be made to FIGS. 6 and 7 where lock member 30 is shown. The other lock member will have the same design so only one will be described in detail. Segment 160 is about 1.5 inches in length and lies in one plane. Segment 162 is connected to segment !60, in the same plane, but is bent ninety degrees clockwise relative to segment 160. Segment 162 is approximately 2.25 inches long. Segment 164 extends at ninety degrees relative to segment 162 and is approximately 1 inch in length. Segment 166 extends from segment 164 again at ninety degrees relative to that segment and is approximately 7.24 inches in length. Segment 168 extends at ninety degrees relative to segment 166 and is approximately 2.25 inches in length. As shown in FIG. 7, segments 160–168 all lie in substantially the same plane. Finally, segment 170 is connected, in another plane, ninety degrees clockwise relative to segment 168 and is approximately 12 inches in length. Segment 170 also includes a cushion member 172.

The second plane intersects the first plane along the longitudinal axis of segment 168 and forms approximately a 30 degree angle, as indicated at 174, between the longitudinal axis of segment 166 and itself. The 30 degree bend of segment 170 relative to segment 166 allows the lock member to stay engaged with its support leg when the caddie is either in its opened or its folded condition.

Each wire 30 or 32 is pivotally connected to a front leg by having segment 160 pass through an opening provided in that leg. The portion of segment passing through the leg is locked by suitable locking means such as a locking cap or push nut shown at 176 in FIG. 3. Segment 160 can be attached to the front leg at a point 21.5 inches from handle 13. In addition, lock rings 178 are placed on the exterior of the leg on segment 160.

It should be understood that what is desirable about lock members 30 is that they pivot relative to the front legs and remain engaged about, yet are freely movable relative to, the rear leg. When the caddie is opened, the lock members should freely slide up the rear leg until they engage stops, lower utility hooks 42 and 46 in FIG. 1, and automatically slide down when the opened caddie is lifted. This downward sliding will also aid in closing the rear legs.

It should also be understood that the lock members do not have to have the same segments as are shown for 30 or 32. For example segment 160 could connect directly to segment 166, omitting segments 162 and 164. The lock member could have a slight curve between segments 160 and 168 or could be positioned to work inside of the rear legs. Thus, a variety of shaped members could work as long as they move easily between and open and closed condition.

Figure 8:
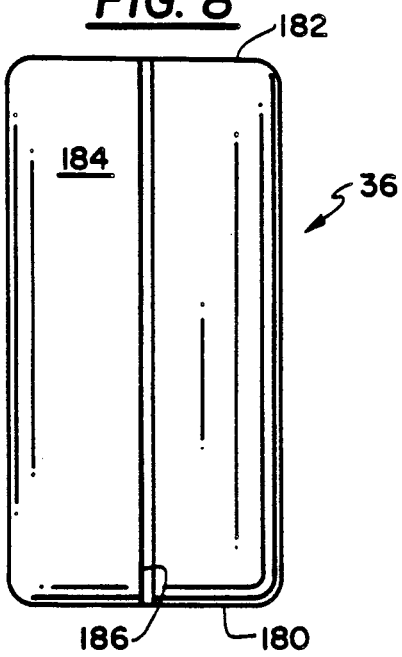
FIG. 8 shows a plan view of a lock roller.
Figure 9:
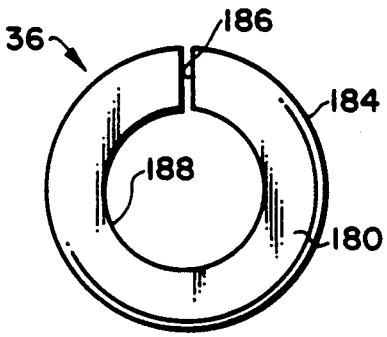
FIG. 9 shows an end elevational view thereof.

Each lock member 30 or 32 also includes a roller 36 or 38 rotatably positioned about segment 168 to permit easy roller movement along the leg. A plan view and an end elevational view of lock roller 36 or 38 are shown on FIG. 8 and FIG. 9, where each roller includes ends 180, 182 on outer surface 184 and a longitudinally extending slit 186. An internal surface is shown at 188. Each roller has an inner and outer diameter of about ¼ and ½ inch, respectively, and is made of rubber or plastic. Longitudinal slit 186 allows the roller to be snap-fitted in place. The internal diameter is large enough to freely rotate about segment 168.

The support legs 12 and 14 have utility hooks 40, 42, 44, and 46 attached to them. Each utility hook 40, 42, 44, or 46 is preferably made of wire about 2 inches long and is slightly bent about its middle. The utility hooks can be affixed by any convenient means including welding or by having the exterior portion threaded and then using nuts 48 on opposite sides of the rear leg. The outer ends can include a cushion cover 54. Top utility hooks 40 and 44 are attached at about 2.5 inches from the top of one of rear legs 12 and 14, and each of bottom utility hooks 42 and 46 are attached at about 13 inches from the top of one of support legs 12 and 14. As noted above, the bottom hooks can act as the stops to limit the movement of the locking members at a desired open position.

The ends of the legs can be covered with protective cover caps 58 to protect floor or other surface from being exposed to the ends of the legs.

U-shaped frame 11, baskets 20, 22, and 24, and support legs 12 and 14 form the skeletal body of the caddie. When the caddie is lifted from the ground by handle 13, frame 11 and support legs 12 and 14 collapse and fold inwardly toward each other.

When the caddie is placed on the ground such that: two support legs 12 and 14 are touching the ground; handle 13 is held; and the caddie is tilted forward such that front legs 16 and 18 tend to move away from rear cross-brace 28, the caddie will unfold, with frame 11 pivoting about 50.

During opening of the caddie, each of locks 30 and 32 slides up one of support legs 12, 14. Each of the support legs 12 and 14 pushes upwardly roller 36 placed around segment 168 of lock 30 or 32. Furthermore, the upward movement of segment 168 is aided by lock roller 36 or 38 (or any other mechanism to reduce friction). Locks 30 and 32 are prevented from moving upwards beyond a certain point by the lower two utility hooks 42 and 46. With rotatable baskets and the automatic locking/ unlocking mechanism, the caddie may be folded and unfolded with little effort. Furthermore, the caddie can be hung by a suitable hanger, such as shown at 190 in FIG. 3, when in its closed or collapsed condition. Hanger 190 can include support fingers 192 and be affixed to a wall or door by screws 194.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A foldable stand comprising:

a main frame;

at least one leg pivotally attached to said main frame and movable between open and closed positions relative to said main frame;

a holding member having one end pivotally attached to said main frame and another end extending at least partially circumferentially about said one leg so that said another end is freely movable along said one leg as said one leg moves between its opened and closed positions; and stop means positioned on said one leg at a predetermined location to intercept and stop movement of said holding member along said one leg thereby defining the limit of the open position of said one leg.

2. A foldable stand as in claim 1 further including at least one container pivotally supported by said main frame.

3. A foldable stand as in claim 1 wherein said main frame includes a pair of spaced apart legs and at least one container pivotally supported between said pair of legs.

4. A foldable stand as in claim 3 wherein the pivot connection between the container and at least one of said pair of legs includes members for engaging said one of said pair of legs to limit the pivotal movement of said container.

5. A foldable stand comprising:

a main frame;

a rear support leg to assist the main frame in standing upright and pivotally connected to the main frame to be movable between an open and a closed position relative to the main frame;

a holding member for the rear support leg pivotally connected to the main frame and extending at least partially circumferentially about the rear support leg so that it is freely movable along the rear support leg as the rear support leg moves between the open and closed position; and stop means positioned on the rear support leg at a predetermined location to intercept and stop movement of the holding member along the rear support leg thereby defining the limit of the open position of the rear support leg.

6. A foldable stand as in claim 5 further including at least one container pivotally supported by said main frame.

7. A foldable stand as in claim 5 wherein said main frame includes a pair of spaced apart legs and at least one container pivotally supported between said pair of legs.

8. A foldable stand as in claim 7 wherein the pivotal support between the container and said pair of legs includes members for engaging at least one of said pair of legs to limit the pivotal movement of said container.

9. An openable and automatically collapsible stand comprising:

a main frame;

at least one leg pivotally attached to said main frame and movable between open and closed positions relative to said main frame;

a holding member having one end pivotally attached to said main frame and another end slidably connected to said at least one leg so that said another end is freely movable relative to said at least one leg as movement thereof occurs between its open and closed positions so that the holding member can be used to control the degree of openness of said at least one leg yet permits said at least one leg to automatically collapse to the closed position upon lifting of said main frame; and stop means positioned on said at least one leg at a predetermined location to intercept and stop movement of said holding member relative to said at least one leg.

10. A stand as in claim 9 wherein said main frame has a bottom end and said at least one leg has a bottom end that in the closed position extends downwardly beyond the bottom end of said main frame.

11. A stand as in claim 9 wherein at least one leg extends outwardly beyond said main frame when in a closed position.

12. A stand as in claim 9 further including a pair of pivotally attached legs.

13. A stand as in claim 12 wherein ends of said legs extend beyond said main frame when said legs are in the closed position.

14. A foldable stand as in claim 9 further including at least one container pivotally supported by said main frame.

15. A foldable stand as in claim 9 wherein said main frame includes a pair of spaced apart legs and at least one container pivotally supported between said pair of legs.

16. A foldable stand as in claim 15 wherein the pivotal support between the container and said pair of legs includes members for engaging at least one of said pair of legs to limit the pivotal movement of said container.

17. A foldable stand as in claim 13 further including at least one container pivotally supported by said main frame.

18. A foldable stand as in claim 13 wherein said main frame includes a pair of spaced apart legs and at least one container pivotally supported between said pair of legs.

19. A foldable stand as in claim 18 wherein the pivotal support between the container and said pair of legs includes members for engaging at least one of said pair of legs to limit the pivotal movement of said container.

20. A collapsible stand comprised of a main frame including a handle portion and one or more legs, a leg assembly pivotally attached to said main frame so that the main frame and leg assembly can move, relative to one another, between open and closed positions, at least one control member operatively connected between the main frame and the leg assembly to control the open position of the stand, said control member being pivotally attached to said main frame and being freely movable relative to said leg assembly as the main frame and leg assembly move into the open position and as the main frame and leg assembly collapse from the open position into the closed position, and a stop member positioned in the path along which said control member is freely movable to stop movement of the control member in an open position at a predetermined location.

21. A collapsible organizer comprised of a main frame member including a handle portion and one or more legs, a secondary frame member pivotally attached to said main frame member so that the main and secondary frame members can move, relative to one another, between relatively open and closed positions, at least one control member operatively connected between the main and secondary frame members to limit the open position of the said frame members and being freely movable as the main and secondary frame members move from the open into their closed position, and stop means positioned on said organizer to stop movement of said at least one control member at a predetermined location and at least one container pivotally secured to said organizer.

22. A collapsible organizer as in claim 21 wherein a portion of the secondary stand is independently ground engagable, relative to the main frame, when the stand is in the closed position.

23. A collapsible organizer as in claim 21 wherein the pivot connection for said at least one container limits the pivotal movement thereof.

24. A collapsible organizer as in claim 23 wherein the pivotal connection for said at least one container includes means for limiting the pivotal movement of said at least one container relative to said main frame.

25. A collapsible organizer as in claim 24 wherein said at least one container includes said limiting means one each side of the container.

26. A collapsible organizer as in claim 21 further including one or more utility support members operatively connected to said stand.

27. A collapsible organizer as in claim 23 wherein said at least one container is pivotally attached to said main frame.

28. A foldable and storable caddy assembly comprised of a foldable stand including:

a foldable stand comprised of a main frame member including a handle portion and one or more legs, a secondary frame member pivotally attached to said main frame member so that the main and secondary frame members can move, relative to one another, between relatively open and closed positions, at least one control member operatively connected between the main and second frame members to limit the open position of the said frame members and being freely movable as the frame members move from an open to a closed position, stop means positioned on said frame to stop movement of said at least one control member, at a predetermined location, at least one container operatively connected to said caddy assembly, and a hanger assembly for attachment to a wall, said hanger assembly being comprised of a support plate and holding means attached thereto for receiving and holding said foldable stand.

29. A collapsible stand comprised of a plurality of frame members that are freely movable, relative to one another, between open and closed positions so that the frame members automatically collapse into the closed position upon lifting of the stand, and at least one container pivotally attached to said stand so as to remain relatively level as the frame members are moved, the pivotal attachment including means for limiting the pivotal movement of said at least one container relative to said stand.

30. A collapsible stand as in claim 29 wherein said plurality of frame members includes a main frame to which said at least one container is pivotally attached.

31. A collapsible stand as in claim 29 further including at least one utility support member connected to said stand.

* * * * *